US007971837B1

(12) United States Patent
Wilkinson

(10) Patent No.: US 7,971,837 B1
(45) Date of Patent: Jul. 5, 2011

(54) STUFFING BOX MAINTENANCE DEVICE

(76) Inventor: Jack Wilkinson, North Zulch, TX (US)

( * ) Notice: Subject to any disclaimer, the term of this patent is extended or adjusted under 35 U.S.C. 154(b) by 0 days.

(21) Appl. No.: 12/711,178

(22) Filed: Feb. 23, 2010

(51) Int. Cl.
*A47B 96/06* (2006.01)
*A47G 29/00* (2006.01)
*A47K 1/00* (2006.01)

(52) U.S. Cl. ..... 248/218.4; 248/219.4

(58) Field of Classification Search ..... 248/218.4, 248/219.4, 217.3, 222.14, 230.1, 230.9, 217.4, 248/229.16; 211/70.6, 71.01, 86.01
See application file for complete search history.

(56) References Cited

U.S. PATENT DOCUMENTS 3,133,643 A * 5/1964 Lester ..... 211/116

* cited by examiner

*Primary Examiner* — Amy J Sterling
(74) *Attorney, Agent, or Firm* — Stephen Powers

(57) ABSTRACT

A stuffing box maintenance device designed to be releasably secured to a polished rod above the stuffing box wherein the stuffing box maintenance device is configured to retain the tools and the maintenance items required to perform a maintenance procedure on the stuffing box. The stuffing box maintenance device further includes a body being planar in manner and rectangular in shape. A mounting ring secured to the body on one end is operable to surroundably mount the polished rod. An opening is located on the mounting ring opposite the body and is configured to allow the stuffing box maintenance device to be laterally coupled to the polished rod. The stuffing box maintenance device further includes a support rod for retaining at least one packing gland. The body is further configured to retain the hand tools necessary to perform a maintenance procedure on the stuffing box.

16 Claims, 2 Drawing Sheets

STUFFING BOX MAINTENANCE DEVICE

FIELD OF THE INVENTION

The present invention relates to a stuffing box maintenance device, more specifically but not by way a limitation, a device design to temporarily suspend the gland cap and other elements of a disassembled oilfield stuffing box engaged with a polished rod oriented in a vertical position to allow an individual to replenish the packing within the stuffing box.

BACKGROUND

Crude oil is typically pumped from underground well or reservoirs utilizing mechanical devices such as but not limited to pumping units. The pumping units power a string of reciprocating sucker rods that extend beneath the ground and are operably coupled to a subsurface pump. The sucker rod string has an integral part thereof a polished rod section, which moves through a dynamic sealing assembly commonly referred to as a stuffing box. The stuffing box is typically located at the well head.

The stuffing box creates a seal with the reciprocating polished rod to prevent the well bore fluids from being vented to atmosphere. Typically, the stuffing box is lubricated to ease the movement of the polished rod through the stuffing box. The lubrication further functions to prevent wear on the seals used to provide the sliding packoff with the polished rod. The lubrication is often referred to as packing and is available in different shapes such as dome or cone shaped.

Routine maintenance requires the lubrication packing be routinely changed within the stuffing box so as to prevent damage to the polished rod. The polished rod is usually in a substantially vertical position with the stuffing box surroundably mounted thereto. An oilfield worker will have to at least partially disassemble the stuffing box to remove the old packing and replace with new packing material. During the performance of this task, the oilfield worker usually removes at least a portion of the stuffing box commonly referred to as a gland cap. The gland cap is surroundably mounted to the polished rod and is moved in an upward direction along the polished rod to allow the user to access the packing material disposed within the stuffing box. One problem that exists during this maintenance procedure is that the worker has no method to retain the gland cap in a suspended position above the stuffing box on the polished rod. The oilfield worker usually must request the assistance of helper to hold the gland cap up and away from the stuffing box so that the oilfield working can access the packing material without interference from the gland cap. This process requires additional labor, which can be costly in a production environment.

Another issue involved in the changing of the packing material of the stuffing box is that the oilfield worker typically does not have a method of holding the required tools to perform the maintenance and perform the task at the same time. Oilfield workers typically utilize an adjustable wrench and a screwdriver or similar tool to remove the gland cap and the packing material. The oilfield will often struggle to perform the maintenance on the stuffing box without dropping their tools.

Accordingly, there is a need for a device that can releasably secure a gland cap surroundably mounted to a polished rod in a position that is above the stuffing box to allow an oilfield worker to access the stuffing box to change the packing material without being inhibited by a gland cap sliding down the polished rod. Additionally, the device should further include a method of holding and organizing the required tools to perform the maintenance of the stuffing box as well as new packing material.

SUMMARY OF THE INVENTION

It is the object of the present invention to provide a device that assists in the maintenance procedures of an oilfield stuffing box operably coupled to a polished rod that can be releasably secured to the polished rod in a position generally above the stuffing box.

Another object of the present invention is to provide a maintenance procedure assistance device for a stuffing box that is operably coupled to a polished rod that has a portion thereof configured to engage with at least the gland cap of the stuffing box subsequent its removal from the stuffing box.

A further object of the present invention is to provide a maintenance procedure assistance device for a stuffing box that is further configured to hold a plurality of packing cones or domes to be installed in the stuffing box.

An additional object of the present invention is to provide a maintenance procedure assistance device that is configured to store and make available for use hand tools that are typically required to perform maintenance on the stuffing box.

Yet another object of the present invention is to provide a maintenance procedure assistance device that is configured to be operably coupled to the polished rod that will not damage the surface of the polished rod.

Still another object of the present invention is to provide a maintenance procedure assistance device designed to facilitate the routine maintenance of a stuffing box wherein the procedure only requires one person.

Another object of the present invention is to provide a maintenance procedure assistance device that can be laterally coupled with a polished rod.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
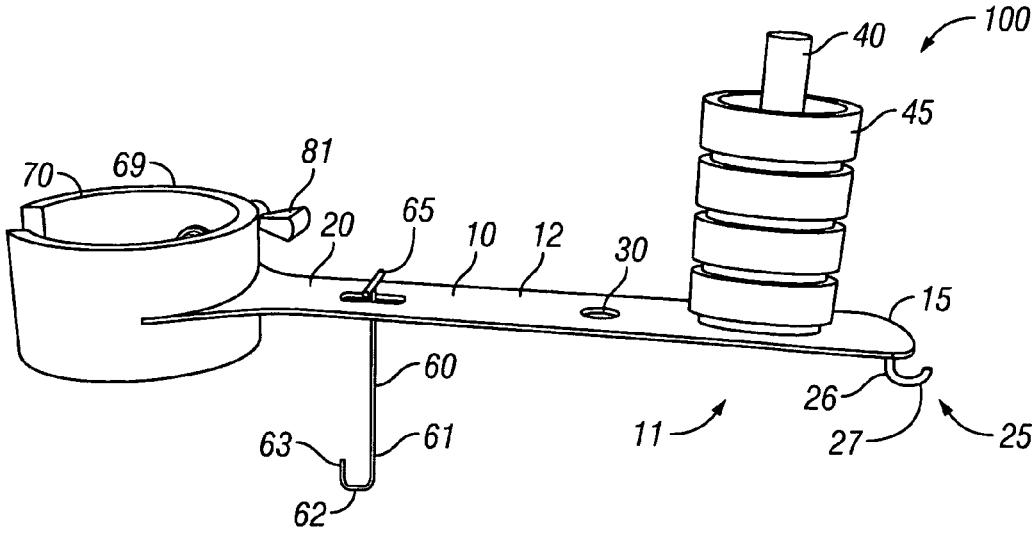
FIG. 1 is a perspective view of the preferred embodiment of the present invention.
Figure 2:
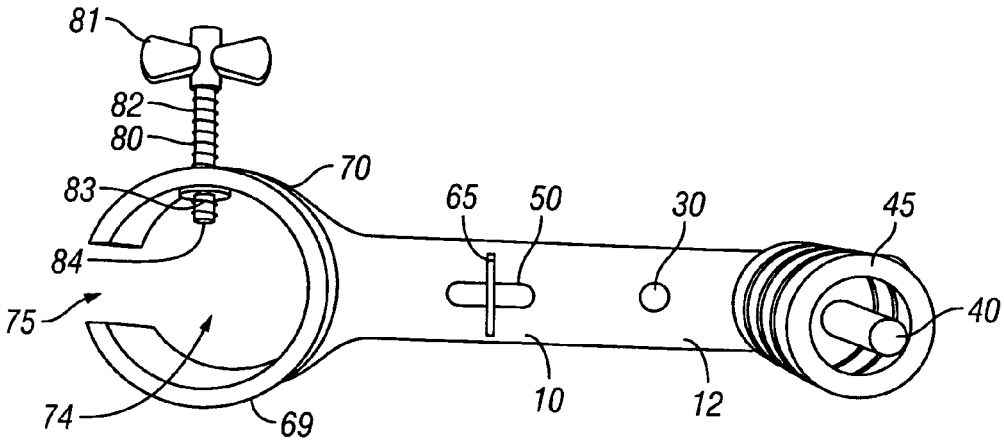
FIG. 2 is a top view of the preferred embodiment of the present invention.

Referring now to the drawings submitted herewith, wherein various elements depicted therein are not necessarily drawn to scale and wherein through the views and figures like elements are referenced with identical reference numerals, there is illustrated a stuffing box maintenance procedure assistance device 100 constructed according to the principles of the present invention.

Referring in particular to FIG. 1 is a stuffing box maintenance procedure assistance device 100 that further includes a body 10 that is generally planar in manner and rectangular in shape. The body 10 is manufactured from a suitable durable rigid material such as but not limited to steel or aluminum. The body 10 has a first end 15 and a second end 20. While no particular length of the body 10 is required, good results have been achieved with a body 10 that is about twelve inches in length.

Proximate the first end of the body 10 is a keeper 25. The keeper 25 is mounted utilizing suitable durable methods such as welding to the bottom 11 of the body 10. The keeper 25 has a first portion 26 that extends downward from the bottom 11 of the body 10 in a generally perpendicular manner. Contiguous with the first portion 26 is the second portion 27 wherein the second portion is generally arcuate in shape. The keeper 25 functions to releasably receive a tool having an aperture bored through its handle such as but not limited to a conventional crescent wrench. As is known in the art many hand tools, such as but not limited to adjustable crescent wrenches, have an aperture journaled through an end of their handle so as to be stored on devices such as peg boards. The keeper 25 functions to releasably retain an adjustable crescent wrench proximate the area in which the user is performing maintenance on a stuffing box. Those skilled in the art should recognize that the keeper 25 could be manufactured in numerous different shapes and still achieve the desired function as described herein.

Mounted proximate the first end 15 on the body 10 is the support rod 40. The support rod 40 is mounted on the upper surface 12 of the body 10 and extends in a generally upward direction and relatively perpendicular to the body 10. The support rod 40 is generally cylindrical in shape and is manufactured from a suitable durable material such as but not limited to steel or aluminum. While no particular length of the support rod 40 is required, good results have been achieved utilizing a support rod 40 that is approximately five inches in length. Additionally, while no particular diameter of the support rod 40 is required, good results have been achieved with a support rod 40 that is approximately three-quarter of an inch in diameter. The support rod 40 functions to receive thereon a plurality of packing glands 45. Packing glands 45 are routinely replaced during maintenance of a stuffing box 99, a disassembled version of a stuffing box 99 being illustrated herein in FIG. 3. Packing glands 45 are typically dome or cone shaped having an aperture centrally located so as to be surroundably mounted around a polished rod 98. It is contemplated within the scope of the present invention that the support rod 40 could be configured to receive as few as one packing gland 45 or a plurality thereof.

Journaled through the body 10 is an aperture 30. The aperture 30 is located adjacent the support rod 40 opposite the first end 15. The aperture 30 is generally annular in shape and functions to receive therein and releasably retain a hand tool such as but not limited to a screwdriver. As is known in the art, screwdrivers are routinely utilized to remove packing glands 45 during maintenance of the stuffing box 99. It is contemplated within the scope of the preset invention that the aperture 30 could be manufactured in numerous different sizes to accommodate a plurality of different size screwdrivers therein. It should be recognized by those skilled in the art that numerous different types of tools could be releasably retained by the aperture 30.

Located on the body 10 proximate the second end 20 is a slot 50. The slot 50 is bored through the body 10 utilizing suitable methods and is generally oval in shape. While no particular size is required, good results have been achieved utilizing a slot 50 that is approximately one to two inches in length. The slot 50 is shaped in the manner illustrated so as to allow the hook 60 to move in a lateral direction along the body 10. The hook 60 is disposed within the slot 50 and extends in a generally downward direction. The hook 60 further includes a top retainer 65 that is configured to engage the upper surface 12 of the body 10 in order to inhibit the hook 60 from being completely journaled through the slot 65. The hook 60 is manufactured from a suitable durable material such as but not limited to metal bar. The hook 60 includes a first member 61 that extends downward from the body 10 in a generally perpendicular manner. Contiguous with the first member 61 opposite the top retainer 65 is a second member 62. The second member 62 is mounted to the first member 61 in a generally perpendicular manner. Contiguous with the second member 62 is a third member 63. The third member 63 of the hook 60 extends in a generally upward direction. The first member 61, second member 62 and third member 63 of the hook 60 form a j-shape that functions to engage a packing gland 45 or gland cap 97 of the stuffing box 99 during maintenance procedures. The third member 63 extends upward approximately three-quarters of an inch from the second member 62. It is contemplated within the scope of the present invention that while in its preferred embodiment the third member 63 extends upward approximately three-quarters of an inch that the third member 63 could be manufactured in numerous different lengths.

Integrally mounted to the body 10 proximate the second end 20 is a mounting ring 70. The mounting ring 70 is constructed of a wall 69 that is formed in a generally annular shape. The mounting ring 70 is secured to the body 10 utilizing suitable durable methods such as but not limited too welding. The mounting ring 70 functions to surroundably mount the polished rod 98 with which the stuffing box is operably engaged. While no particular size is required for the mounting ring 70, good results have been achieved utilizing a mounting ring 70 that is approximately two inches in diameter. The mounting ring 70 further has an opening 75 operably couple to a polished rod 98 in a generally lateral direction. The opening 75 allows the mounting ring 70 to be surroundably positioned around the polished rod 98 as typically the polished rod 98 does not have an accessible end. While no particular size of opening 75 is required, good results have been achieved utilizing an opening 75 that is at least slightly greater than one and a quarter inches to one and a half inches in width so as to accommodate a conventional sized polished rod 98 of approximately equivalent diameters.

The mounting ring 70 has rotatably mounted thereto a fastener 80. The fastener 80 functions to releasably secured the stuffing box maintenance procedure assistance device 100 to the polished rod 98 in a position that is above the stuffing box 99 as shown in particular in FIG. 3. The fastener 80 is manufactured utilizing conventional material such as a threaded bolt or screw. Mounted to the first end 82 of the fastener 80 is a handle 81. The handle 81 functions to allow the user to engage the fastener 80 and rotate the fastener such that the fastener 80 protrudes into the mounting ring 70 and engages the polished rod 98. While the handle 81 is shown in the drawings submitted herewith as being configured in a wing-nut style manner, it is contemplated within the scope of the present invention that the handle could be manufactured in numerous different shapes. The second end 83 of the fastener 80 protrudes into the orifice 74 of the mounting ring 74. Proximate the second end 83 of the fastener 80 is a tip 84. The tip 84 is manufactured of a material such as but not limited to plastic or Teflon. The tip 84 functions to engage the polished rod 98 present in the orifice 74 of the mounting ring 70 and substantially inhibit any scarring or scratching of the surface of the polished rod 98.

While the stuffing box maintenance procedure assistance device 100 has been discussed herein in a preferred embodiment, it is contemplated within the scope of the present invention that the stuffing box maintenance procedure assistance device 100 could be utilized to assist a user perform maintenance in any area where a cylindrical or rod shaped object is proximate thereto in order to allow the stuffing box maintenance procedure assistance device to be coupled to and provide a user tools and maintenance items needed.

Figure 3:
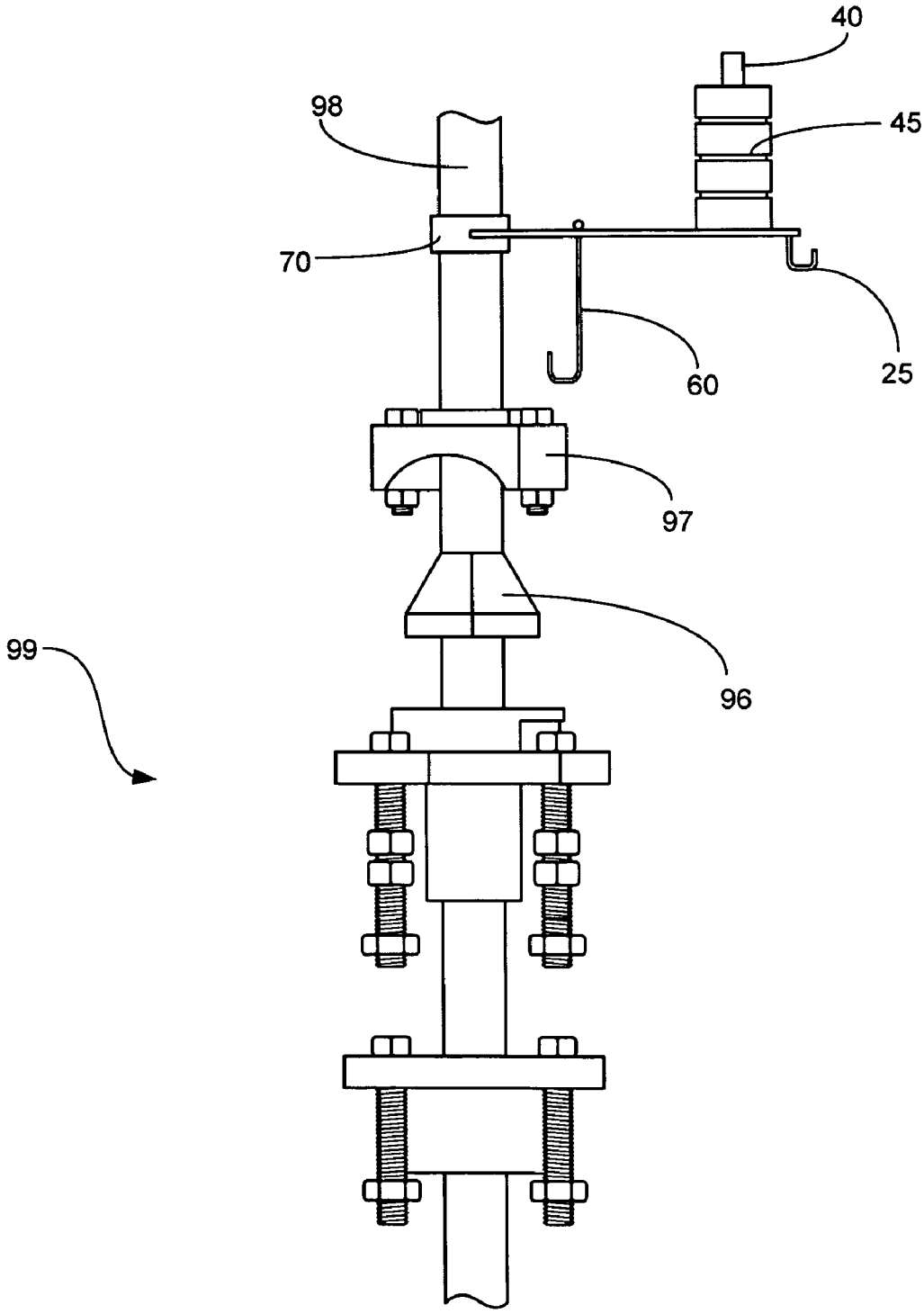
FIG. 3 is the preferred embodiment of the present invention operably engaged with a polished rod superimposed a stuffing box.

A description of the operation of the stuffing box maintenance procedure assistance device 100 is as follows. Referring in particular to FIG. 3, in use, the user will place the stuffing box maintenance procedure assistance device 100 adjacent to the polished rod 98 and generally above the stuffing box 99 for which maintenance is required such as but not limited too replacement of the packing glands 45. The user journals the polished rod 98 through the opening 75 and into the orifice 74 of the mounting ring 70. The fastener 80 is rotated such that the tip 84 engages the polished rod 98 with sufficient force so as to releasably secure the stuffing box maintenance procedure assistance device 100 to the polished rod 98 above the stuffing box 99. The user may utilize the keeper 25 and aperture 30 to store any tools required to disassemble the stuffing box 99. The user then places the required amount of packing glands 45 that will be used during the maintenance procedure on the support rod 40. The gland cap 97 is removed from the stuffing box 99 and moved in an upward direction along the polished rod 98. The user engages the hook 60 and moves laterally towards the mounting ring 70 so as to allow the third member 63 of the hook 60 to engage the gland cap 97. The hook 60 functions to suspend the gland cap 97 on the polished rod 98 above the stuffing box 99 in order to allow the user to access the used packing gland 96 that needs to be replaced. The user can perform maintenance on the stuffing box 99 while the hook 60 suspends any disassembled elements of the stuffing box 99 up and away from the user so as to reduce the interference of the elements during the maintenance procedure. Upon replacement of the used packing material 96, the user will disengage the gland cap 97 from the hook 60 and slide the gland cap 97 down the polished rod 98 to reassemble the stuffing box 99.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A maintenance assistance device configured to releasably secure at least one hand tool and at least one maintenance item proximate a work area comprising:

a body, said body being generally planar in manner having rounded corners, said body having a first end and a second end;

a mounting ring, said mounting ring being generally annular in shape, said mounting ring being contiguous with said first end of said body, said mounting ring having an orifice, said mounting ring configured to releasably secure the device to a cylindrical shaped object;

a first aperture, said first aperture being generally oval in shape, said first aperture being proximate said first end of said body;

a second aperture, said second aperture being generally annular in shape, said second aperture proximate said second end of said body, said second aperture configured to receive a portion of a hand tool therein.

2. The device as recited in claim 1, and further including a hook, said hook being journaled through said first aperture, said hook extending in a generally downward direction, said hook operable to engage an item surroundably mounted to the cylindrical shaped object journaled through said orifice wherein the item is below the device.

3. The device as recited in claim 2, wherein said mounting ring further includes an opening, said opening for allowing the cylindrical shaped object to be laterally coupled to the device.

4. The device as recited in claim 3, and further including a fastener, said fastener rotatably coupled to said mounting ring, said fastener configured to engage the cylindrical shaped object disposed within said orifice so as to releasably secure the device thereto, said fastener further including a tip, said tip configured to prevent damage to the cylindrical shaped object.

5. The device as recited in claim 4, and further including a support rod, said support rod mounted to said body proximate said second end, said support rod extending upward from said body, said support rod for receiving thereon at least one maintenance item wherein the maintenance item is configured with an aperture.

6. The device as recited in claim 5, and further including a keeper, said keeper being integrally mounted to said body proximate said second end, said keeper being arcuate in shape, said keeper configured to receive at least one hand tool thereon.

7. A stuffing box maintenance device comprising:

a body, said body being generally planar in manner, said body having a first end and a second end, said body further including a slot, said slot being generally oval in shape, said slot proximate said first end;

a support rod, said support rod being mounted to said body, said support rod being proximate said second end of said body, said support rod extending upward from said body and being generally perpendicular therewith, said support rod operable to receive at least on packing gland thereon;

a mounting ring, said mounting ring contiguous with said body, said mounting ring being formed proximate said first end, said mounting ring being annular in shape and having an orifice, said orifice configured to receive a polished rod therein, and wherein the stuffing box maintenance device is configured to be releasably secured to a polished rod generally above a stuffing box engaged therewith.

8. The stuffing box maintenance device as recited in claim 7, wherein said mounting ring further includes an opening, said opening located on said mounting ring opposite said body, said opening configured to receive a polished rod therethrough in a generally lateral direction in order to allow said mounting ring to be surroundably mounted to the polished rod.

9. The stuffing box maintenance device as recited in claim 8, and further including a hook, said hook journaled through said slot, said hook extending in a generally downward direction from said body, said hook operable to engage at least one element of the stuffing box subsequent the stuffing box being disassembled for maintenance.

10. The stuffing box maintenance device as recited in claim 9, and further including a fastener, said fastener being operably coupled to said mounting ring, said fastener configured to engage the polished rod located in said orifice, said fastener further including a tip, said tip being manufactured from plastic so as to substantially prevent scratching of the polished rod, said fastener for releasably securing the stuffing box maintenance device to the polished rod above the stuffing box.

11. The stuffing box maintenance device as recited in claim 10, and further including a keeper, said keeper secured to said second end of said body, said keeper extending in a generally downward direction, said keeper being generally hook-shaped, said keeper configured to support a hand tool having an aperture thereon.

12. The stuffing box maintenance device as recited in claim 11, and further including an aperture, said aperture being journaled through said body, said aperture being intermediate said support rod and said slot, said aperture configured to receive therein and releasably secure a hand tool.

13. A stuffing box maintenance device operable to engage a polished rod proximate to a stuffing box wherein the stuffing box maintenance device is generally above the stuffing box comprising:

a body, said body being planar in manner, said body having a first end and a second end, said body having a first aperture, said first aperture being oval in shape, said first aperture being proximate said first end;

a mounting ring, said mounting ring being secured to said first end of said body, said mounting ring having one wall being generally annular in shape, said mounting ring having an orifice sufficient in size to receive therein the polished rod, said mounting ring being configured to surroundably mount the polished rod, an opening, said opening located in said one wall of said mounting ring opposite said body, said opening configured to allow the stuffing box maintenance device to be laterally coupled to the polished rod, and a hook, said hook journaled through said slot first aperture, said hook extending in a generally downward direction from said body, said hook further including a top member, said top member configured to maintain said hook within said first aperture, said hook operable to engage at least one element of the stuffing box subsequent the stuffing box being disassembled for maintenance;

a support rod, said support rod mounted to the upper surface of said body, said support rod extending upward from said body, said support rod operable to releasably secure a plurality of packing glands;

a second aperture, said second aperture being annular in shape, said second aperture being proximate said second end of said body, said second aperture operable to receive a portion of a hand tool therein.

14. The stuffing box maintenance device as recited in claim 13, and further including a fastener, said fastener being operably coupled to said mounting ring, said fastener configured to engage the polished rod located in said orifice, said fastener further having a first end and a second end, said first end configured as an interface for a user to rotate said fastener, said second end further including a tip, said tip being manufactured from plastic, said tip configured to substantially inhibit damage to the polished rod, said fastener for releasably securing the stuffing box maintenance device to the polished rod above the stuffing box.

15. The stuffing box maintenance device as recited in claim 14, and further including a keeper, said keeper secured to said second end of said body, said keeper extending in a generally downward direction, said keeper being generally hook-shaped, said keeper configured to support an adjustable crescent wrench having an aperture.

16. The stuffing box maintenance device as recited in claim 15, wherein said mounting ring is configured to be releasably secured to a polished rod of at least one of the following sizes: one and a half inch or one and a quarter inch.

* * * * *